US006816440B2

(12) United States Patent
Born et al.

(10) Patent No.: US 6,816,440 B2
(45) Date of Patent: Nov. 9, 2004

(54) PORTABLE OBJECT INCLUDING MEANS FOR ACTIVATING AN ELECTRONIC FUNCTION AND METHOD FOR CONTROLLING SUCH AN ELECTRONIC FUNCTION

(75) Inventors: Jean-Jacques Born, Morges (CH); Frédéric Meylan, Neuchâtel (CH); Jean-Pierre Wattenhofer, Neuchâtel (CH)

(73) Assignee: Asulab S.A., Marin (CH)

( * ) Notice: Subject to any disclaimer, the term of this patent is extended or adjusted under 35 U.S.C. 154(b) by 351 days.

(21) Appl. No.: 10/046,202

(22) Filed: Jan. 16, 2002

(65) Prior Publication Data

US 2002/0118605 A1 Aug. 29, 2002

(30) Foreign Application Priority Data

Feb. 23, 2001 (CH) ..... 0333/01

(51) Int. Cl.[7] ..... G04C 17/00
(52) U.S. Cl. ..... 368/69
(58) Field of Search ..... 368/69, 294–296

(56) References Cited

U.S. PATENT DOCUMENTS 3,626,256 A * 12/1971 Brown ..... 257/417
3,777,472 A * 12/1973 Iinuma ..... 368/255
4,257,117 A * 3/1981 Besson ..... 368/69
4,444,515 A 4/1984 Clark
4,995,015 A * 2/1991 Chiang ..... 368/11
5,742,564 A * 4/1998 Kuschel et al. ..... 368/69
5,940,349 A * 8/1999 Stewart ..... 368/69

FOREIGN PATENT DOCUMENTS

EP 0 758 107 A 2/1997
FR 2 350 633 A 12/1977

OTHER PUBLICATIONS

Piguet et al., "Nouvelles Possibilities D'entrer des donnees dans une montre" Bulletin Annuel de la Societe. Suisse de Chronometried et du Laboratoire Suisse de Recherches Horlogeres, Societe Suisse de Chronometrie. Neuchatel, CH. vol. 7, No. 4, 1978, pp. 499–502.

* cited by examiner

*Primary Examiner*—David Martin
*Assistant Examiner*—Thanh S Phan
(74) *Attorney, Agent, or Firm*—Sughrue Mion, PLLC

(57) ABSTRACT

The present invention concerns a portable object such as, in particular, a timepiece (1) including means for controlling at least an electronic function such as an horological function, these control means including at least a touch-sensitive key (16) for selecting the desired electronic function, characterized in that the control means further include a strain gauge (22) allowing the selection of the desired electronic function to be confirmed and/or the electronic function to be activated, the confirmation and/or activation of said electronic function being effected by applying pressure to the portable object via the effect of which the strain gauge (22) generates a control signal which will be applied to an electronic data processing circuit, said portable object also being able to include means able to emit an acoustic signal to indicate to a user that the desired function has actually been switched on.

26 Claims, 7 Drawing Sheets

PORTABLE OBJECT INCLUDING MEANS FOR ACTIVATING AN ELECTRONIC FUNCTION AND METHOD FOR CONTROLLING SUCH AN ELECTRONIC FUNCTION

BACKGROUND OF THE INVENTION

The present invention concerns a portable object, such as, in particular, a timepiece, including means for activating an electronic function such as an horological function. The present invention also concerns a method for controlling an electronic function of the aforementioned type.

Numerous devices for inputting data into electronic means intended for processing such data are already known. These devices may include, for example a keyboard formed of a plurality of keys, each of the keys being associated with a subjacent sensitive pad of a sensor which controls the inputting of a data item associated with the key in response to a finger being placed on the key. A keyboard of this type is for example disclosed in European Patent Application No. EP-A-0 674 247 in the name of the Applicant in which it is associated with a watch to control various functions such as time-setting or starting and stopping a chronograph. When it is fitted to a watch, such a keyboard advantageously allows the usual push-buttons to be replaced.

The keys of keyboards incorporated in watches are formed by touch-sensitive sensors of different types, for example piezo-sensitive, photosensitive, resistive or capacitive type sensors. In the latter case, the sensitive pad of each sensor can be formed by a transparent electrode formed on the inner face of the crystal. By placing a finger on a pad of the outer surface of the crystal which faces the electrode, an electric capacitor is formed between the finger and the electrode which are separated by the dielectric formed by the watch crystal. An electronic circuit sensitive to the capacitance value of the capacitor identifies the electrode set in action by placing the finger and deduces the character or operation thereby selected for one or other of the aforementioned applications.

As already stated, one of the essential advantages of keyboards with touch-sensitive keys lies in the fact that, when fitted to portable objects of small dimensions such as, in particular, a wristwatch, such keyboards enable the push-buttons which are normally fitted to such wristwatches, to be omitted. As will be easily understood, this allows the manufacturing costs of such watches to be substantially reduced, and excellent sealing thereof to be guaranteed.

A watch including control means formed by a set of touch-sensitive keys has, however, several drawbacks. One of such drawbacks lies in the fact that the touch-sensitive keys are very sensitive to the touch. Thus the user of the watch has only to inadvertently brush against one of the keyboard keys for the character or operation corresponding to such key to be selected and activated by the electronic data processing circuit.

Moreover, the touch-sensitive sensors must be constantly powered by an electric current to be able to be used when required, which poses obvious problems of electric power consumption, which are all the more important when the touch-sensitive keys in question are very particularly intended to be fitted to objects which are of small dimensions and which thus have limited power reserves.

One of the functions of a timepiece which is most frequently controlled by means of a touch-sensitive keyboard is the stop or start function of a chronograph. It has unfortunately been realised during use that such a technique is particularly awkward and difficult to implement. Indeed, a user who wishes, for example, to time a sporting event, has to take his eyes off the event to be able to find and activate the pad of the crystal corresponding to the appropriate control key for starting the chronometer. This results in timing which is often inaccurate and thus unsatisfactory for the user.

Finally, with a matrix of high density touch-sensitive keys there is a significant risk of touching the wrong sensor and thus activating the wrong key. It is clear that the surface area of a fingerprint is not small with respect to the that of a watch crystal, which it itself limited when the watch is a wristwatch. It is thus difficult to place the finger on the watch crystal above the desired electrode, without influencing the adjacent electrodes at the same time. Thus in order to identify which of the electrodes influenced was the one targeted, the electronic means incorporated in the watch have to develop complex identification strategies.

SUMMARY OF THE INVENTION

The object of the present invention is thus to overcome the above problems and drawbacks in addition to others by proposing a portable object including means allowing in particular the desired electronic function to be selected without any risk of making a mistake or inadvertently activating an undesired electronic function.

The present invention thus concerns a portable object such as, in particular, a timepiece including means for controlling at least an electronic function such as an horological function, these control means including at least a touch-sensitive key for selecting the desired electronic function, an electronic data processing circuit identifying the touch-sensitive key activated and deducing therefrom a character or operation thereby selected, characterised in that the control means further include a strain gauge allowing the selection of the desired electronic function to be confirmed and/or the electronic function to be activated, the confirmation and/or activation of said electronic function being effected by applying pressure on the portable object via the effect of which the strain gauge generates a control signal which will be applied to the electronic data processing circuit, said portable object also being able to include means able to emit an acoustic signal to indicate to a user that the desired function has actually been switched on.

As a result of these features, it is no longer necessary to power the keyboard keys permanently. When the user places a finger on one of the touch-sensitive keys of the keyboard corresponding to the character or operation which he wishes to effect, he simultaneously presses down on the portable object with his finger. Detecting the application of pressure on the portable object, the strain gauge generates, in a conventional manner, an electric signal which will be applied to an electronic data processing circuit corresponding to the different functions of the portable object. This control circuit will then switch on the touch-sensitive keyboard keys, identify which of the touch-sensitive keys was activated by the user placing his finger on it, and deduce the character or operation selected for one of other of he applications which it can control.

Consequently, the risk of seeing the user inadvertently activate a function by accidentally brushing against a keyboard key is avoided. Indeed, the character or operation corresponding to the keyboard key on which the user has placed his finger will not be selected until said user has also exerted pressure on the portable object to confirm his selection.

This latter arrangement proves particularly advantageous especially in the particular case in which the user wishes to use the timing function. Having previously placed his finger on the particular touch-sensitive key which will enable him to start the chronometer, the user will be able to watch the event, for example a sporting event, which he wishes to time closely, then to exert pressure on the portable object to start timing at the right moment, without taking his eyes off the event.

The present invention also concerns a method for controlling at least an electronic function such as an horological function of a portable object of the aforementioned type, including the step consisting in selecting the desired electronic function by applying a finger to the touch-sensitive key associated with said function, characterised in that it further includes the step consisting in exerting mechanical pressure on the portable object in order to confirm the selection of said desired electronic function and/or to activate said function and, if necessary, to generate an acoustic signal to indicate to a user that the desired function has actually been switched on.

Other features and advantages of the present invention will appear more clearly upon reading the following detailed description of an example embodiment of the portable object according to the invention, this example being given purely by way of non-limiting illustration, in conjunction with the annexed drawings, in which:

DETAILED DESCRIPTION OF THE INVENTION

The present invention proceeds from the general inventive idea which consists in associating with first control means including a keyboard with touch-sensitive keys by means of which a user may select one or other of the electronic functions of a portable object such as, in particular, a watch, second control means including a strain gauge allowing the selection of the desired electronic function to be confirmed and/or said function to be activated by applying mechanical pressure to the portable object.

Such a combination of means eliminates the problems generally linked to the use of touch-sensitive keyboard keys for introducing data into electronic processing means for said data which are, in particular, the high sensitivity of the keys to a finger being placed thereon, and the fact that the user is obliged to look at which key he is activating in order to ensure that the desired function has been properly selected.

Moreover, according to the present invention, the strain gauge performs the function of a push-button. Indeed, watches including both a keyboard with touch-sensitive keys and one or more push-buttons are known, the keyboard allowing the user to select the desired electronic function while the push-buttons allow said function to be switched on or off. This solution allows certain of the problems described above to be avoided, but has the main drawback that the push-buttons which are fitted to the watch are expensive to manufacture and alter the sealing of the case of said watch. Furthermore, it is necessary to indicate to the user by means of fixed or changing symbols which push-button has to be activated to switch the desired function on or off, which may lead to confusion.

It will be noted straight away that, although the following description concerns a timepiece and, in particular, a wristwatch, the present invention is not limited to such a timepiece and may easily be applied to any other portable object in which a keyboard with touch-sensitive keys is arranged for selecting and activating a plurality of electronic functions.

Figure 1:
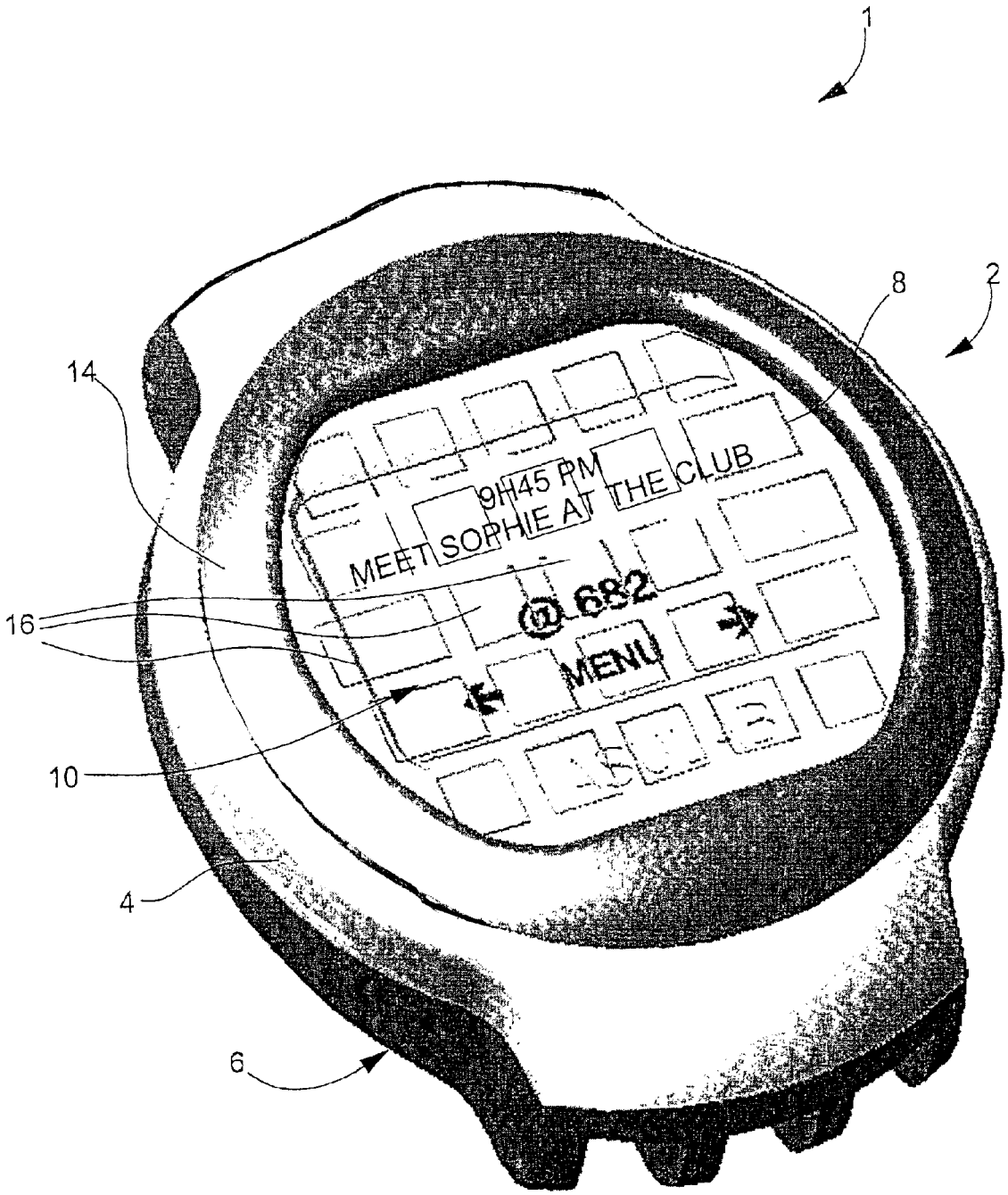
FIG. 1 is a general perspective view of a timepiece according to the present invention showing a way of arranging the keys of a keyboard each in conjunction with a subjacent sensor which controls the input of a data item associated with said key.

Reference will be made first of all to FIG. 1 which shows a timepiece according to the invention, designated as a whole by the general reference numeral 1. Timepiece 1 includes in a conventional manner a case provided with a middle part 4 and a back cover 6 which delimits case 2 in its lower part. In the example shown, case 2 includes a back cover 6 which is distinct from middle part 4. It goes without saying however that the present invention applies in the same way to a mono-block case with a back cover made in a single piece with the middle part. Case 2 may be made, for example, of a plastic material in accordance with well known injection moulding techniques. The present invention is however not limited to the selection of such a material and case 2 could be made of any type of material suited to the requirements of the horological industry such as, in particular, steel.

In its upper part, case 2 is delimited by a crystal 8 covering display means 10 for time-related or other data. In the example shown in FIG. 1, these display means 10 are formed of a matrix type liquid crystal display cell 12. They are thus digital data display means. One could also envisage using analogue time display means including an hour hand, a minute hand and a second hour which move above a dial formed by a liquid crystal display cell which is also capable of displaying different types of information or data. According to another variant, the hands can move above a conventional dial. The symbols representing the characters or functions which can be selected by the person wearing the watch are then printed, engraved or transferred onto the crystal, the bezel or the dial of the watch.

Finally, case 2 includes on its upper periphery, a bezel 14 which may, if required, secure crystal 8 onto case 2. Bezel 14 is fixedly mounted on case 2 for example by bonding or ultrasound welding. Another solution which will be examined hereinafter in conjunction with FIG. 2 consists in securing bezel 14 onto case 2 by screwing it thereon.

According to the present invention, timepiece 1 includes means for controlling the electronic functions such as an horological function. In the example illustrated in FIG. 1, these control means are formed by a plurality of tactile or touch sensitive sensors 16, in this case twenty-five in number, arranged in a matrix defining five lines and five columns of touch-sensitive pads which are generally square in shape. The set of sensitive pads 16 is carried by crystal 8 and extends over most of said crystal 8. According to an alternative embodiment, part of the sensitive pads of tactile sensors 16 may also be located on bezel 14 of case 2 of timepiece 1.

As crystal 8 occupies most of the upper surface of case 2, the sensitive zone defined by the matrix of tactile sensors 16 for activating an electronic function is relatively large, without either the time display in analogue or digital form, or the dimensions or external appearance of timepiece 1 being altered.

Figure 2:
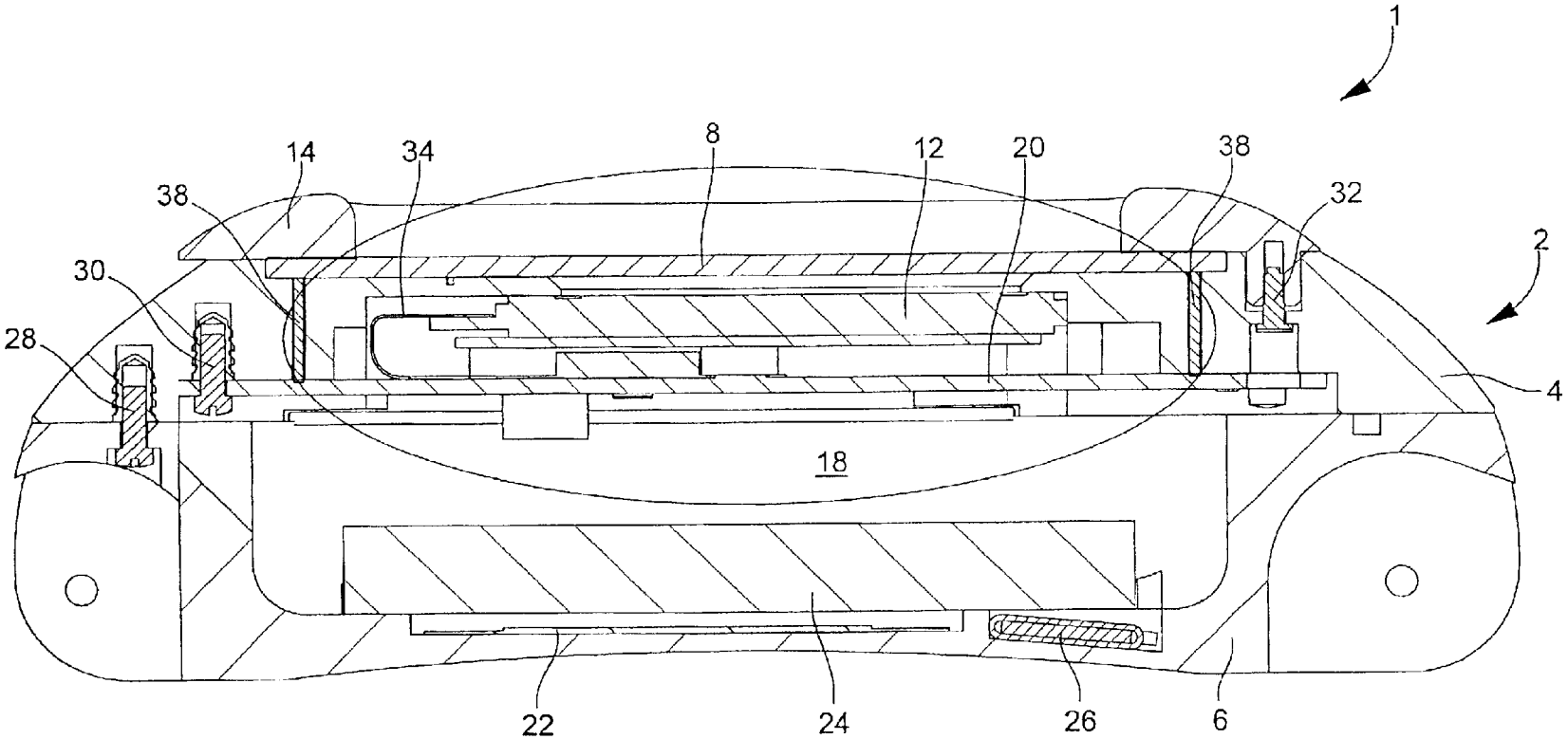
FIG. 2 is a cross-section of the timepiece shown in FIG. 1.

Reference will now be made to FIG. 2, which is a cross-section of timepiece 1 shown in FIG. 1. Middle part 4 of timepiece 1 defines a central cavity occupied, in a conventional manner, by an electronic watch movement 18 carried by a printed circuit board 20. This electronic movement 18 includes, amongst other things, a time base circuit, a frequency divider circuit powered by the time base, a data control and processing circuit connected to the divider circuit and the matrix type liquid crystal display cell 12 controlled by the control circuit.

The data control and processing circuit fulfils various functions. It maintains, in particular, the oscillations of the quartz oscillator of the time base circuit, divides the quartz frequency, corrects the working of the watch and powers, if necessary, the motors and liquid crystal displays. It also controls, in conjunction with tactile sensors 16 and a strain gauge 22 whose description will follows, special functions such as the date, chronograph, alarm, time zones, and allows certain readings to be corrected and time-setting to be effected. It goes without saying that for selecting or switching the aforementioned electronic functions on or off by means of tactile keys 16, an electronic data processing circuit distinct from electronic movement 18 for controlling the working of timepiece 1, may be envisaged.

The data control and processing circuit is supplied with a current by an accumulator 24 intended to be recharged when run down. In the example shown in FIG. 2, accumulator 24 is charged by induction. For this purpose, a first coil forms the primary of the charger (not shown), whereas a second coil 26, placed in the charging circuit of accumulator 24, forms the secondary of said charger. Since accumulator 24 is fitted to a timepiece, it is preferable to recharge the latter by induction rather than to use ohmic contacts for connecting it to the charger, in order to avoid altering the sealing of case 2 of timepiece 1. It will be understood nonetheless that the proper working of timepiece 1 according to the invention is guaranteed whatever method is selected for charging accumulator 24. It will also be understood that the data control and processing circuit could be powered by a non-rechargeable battery.

As can be seen in FIG. 2, middle part 4 of timepiece 1 is fixedly mounted on back cover 6 by means of screws 28. Likewise, the printed circuit board is secured to middle part 4 by means of screws 30. Finally, bezel 14 is fixed to middle part 4 by screws 32. Moreover, matrix type display cell 12 is electrically connected to printed circuit board 20 by a flexible connector 34.

Figure 3:
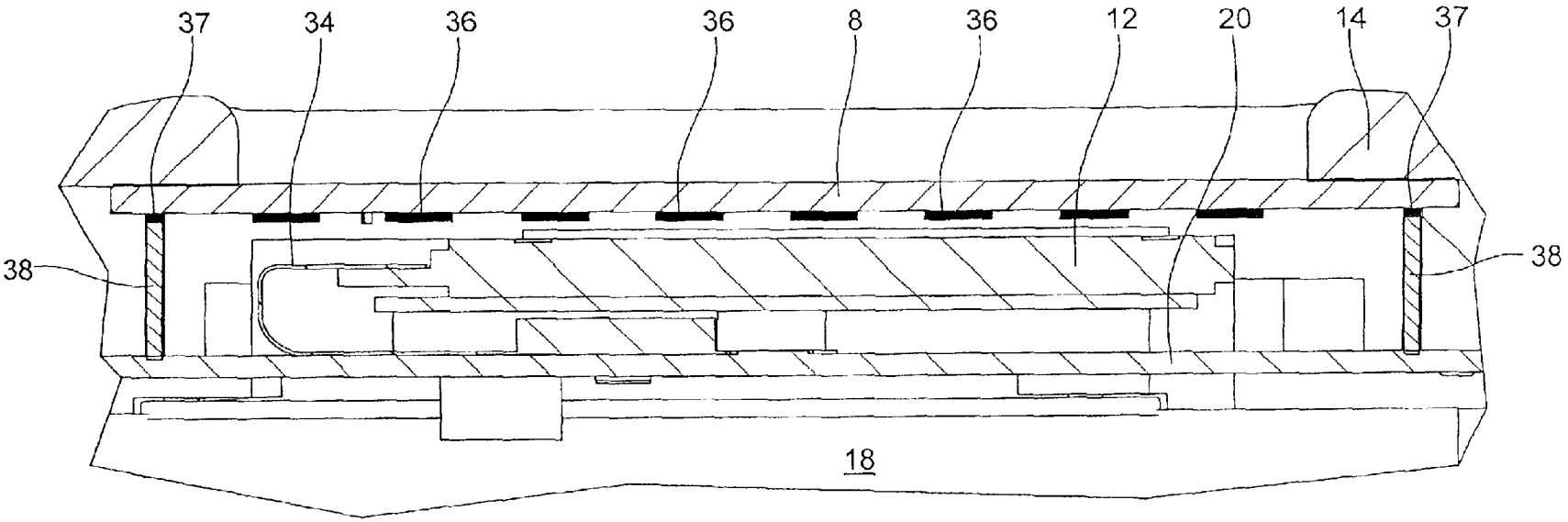
FIG. 3 is a larger scale view of the zone surrounded by a circle in FIG. 2 more particularly showing the structure of a touch-sensitive key of the keyboard.
Figure 5:
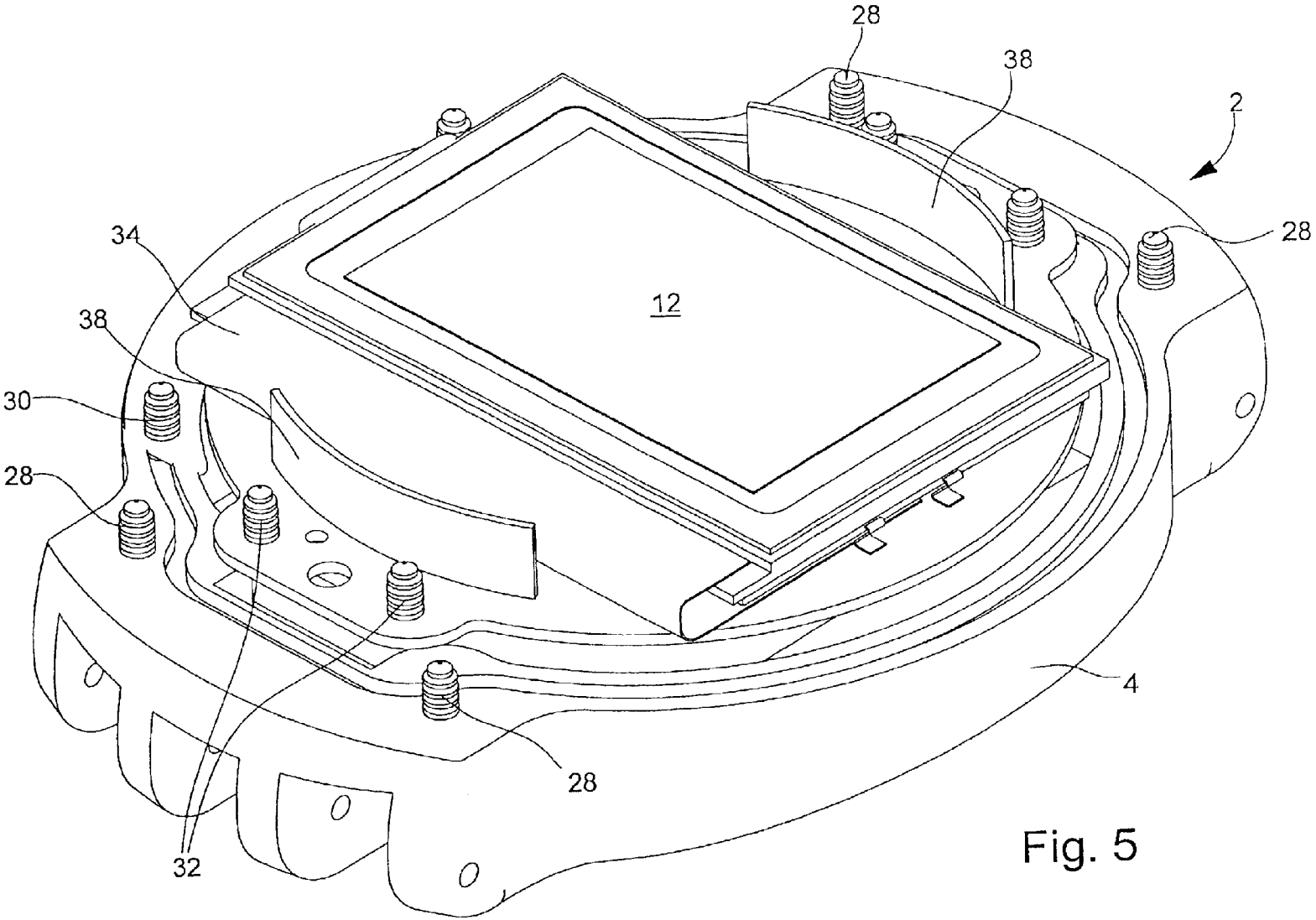
FIG. 5 is a perspective view of the timepiece shown in FIG. 1, the crystal having been removed.

FIG. 3 is a larger scale detail view of the cross-section shown in FIG. 2 showing the sensitive pads of tactile sensors 16. According to a particular embodiment of the invention, the tactile sensors are of the capacitive type, their sensitive pads 16 being formed by transparent electrodes 36 deposited on the lower face of crystal 8. Each electrode 36 is electrically connected to the control circuit of electronic watch movement 18 via a plurality of contact pads 37 located on the periphery of crystal 8 and two connectors 38 each formed of a succession of vertical conductive and insulating strips, for example made of elastomer, which carry over the electric contacts from the lower face of crystal 8 onto the upper face of printed circuit board 20 (see FIG. 5). Those skilled in the art know how to form transparent electrodes on the surface of a crystal and how to connect a plurality of capacitive tactile sensors to an electronic control unit located inside a watch case.

Those skilled in the art are also aware of the operating principle of capacitive tactile sensors. This is why the broad principles will be recalled only briefly here.

Each of the capacitive sensors is connected in parallel across earth and an input of the electronic data processing circuit. The electronic data processing circuit includes a series of voltage controlled oscillators, the frequency of each of these oscillators varying as a function of the total capacitance present across its input and earth. If the finger of the person wearing the watch is not placed on the crystal facing a particular electrode, one of the plates of the corresponding capacitive sensor is consequently not formed. In such case, the total capacitance present across the oscillator's input and earth is equivalent to the capacitance of the parasitic capacitor associated with this capacitive sensor. Conversely, when the finger is placed on the crystal facing this electrode, the two plates of the corresponding sensor are formed. The total capacitance across the oscillator's input and earth is kept equivalent to the sum of the capacitance of the capacitive sensor and the capacitance of the parasitic sensor. Thus, the oscillation frequency of each of the voltage controlled oscillators varies as a function of the presence or absence of the finger on the part of the crystal which is facing the electrode associated with said oscillator. This frequency change is detected by the frequency detector associated with the voltage controlled oscillator.

According to the invention, tactile sensors 16 are associated with the aforementioned strain gauge 22. By means of tactile sensors 16, one may thus select an electronic function such as an horological function identified by a character transcribed onto crystal 8 of timepiece 1, or displayed by display cell 12, then confirm this selection and switch the selected function on or off by exerting pressure on case 2 of said timepiece 1.

Figure 4:
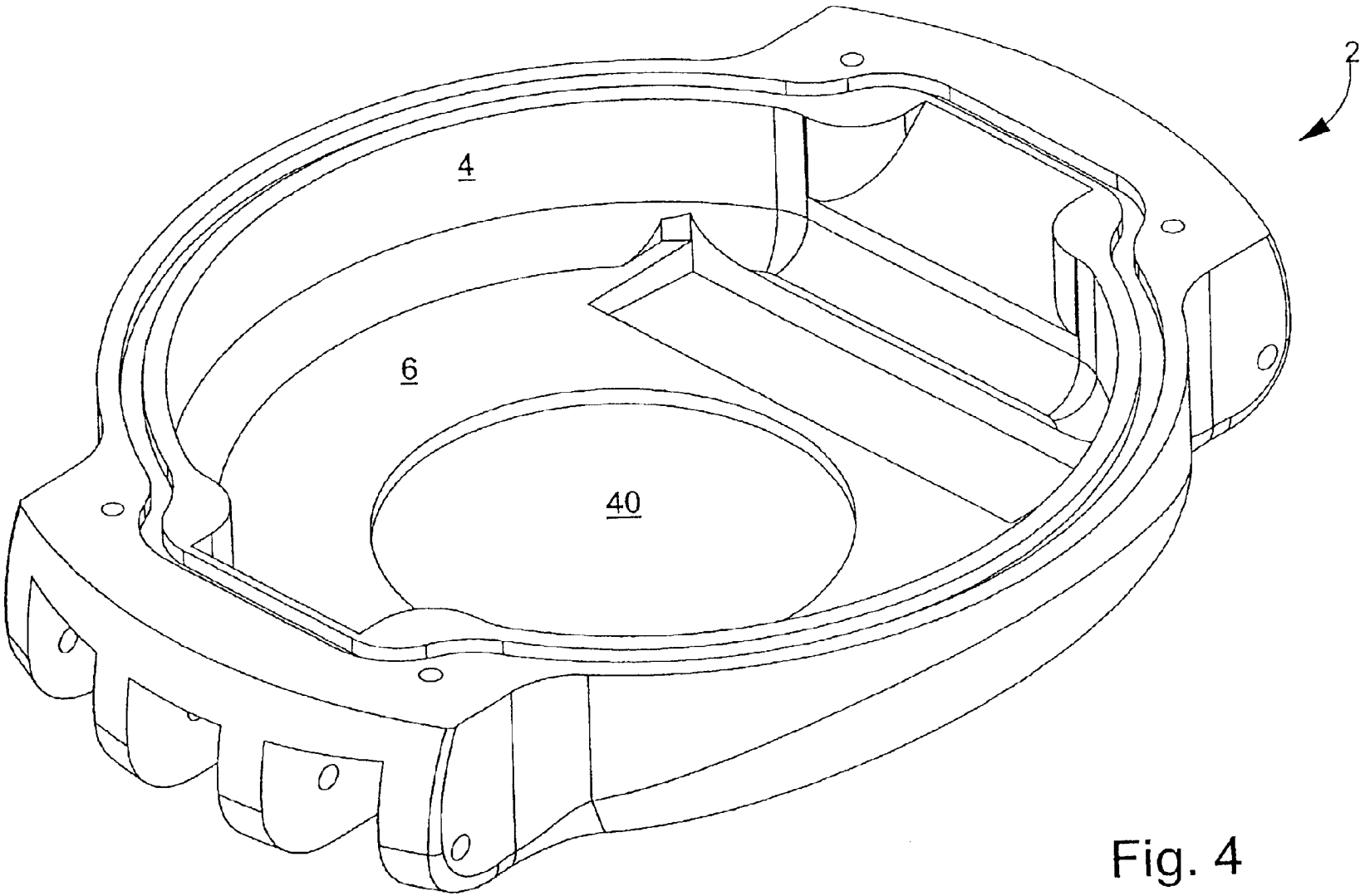
FIG. 4 is a perspective view of the back cover of the watch case shown in FIG. 1.

According to an alternative embodiment, strain gauge 22 is formed by the piezoelectric transducer which is conventionally present in most timepieces and whose primary role is to operate as a sound generator for an alarm device. As can be clearly seen in FIG. 4, a cavity 40 is provided in back cover 6 of case 2 of watch 1 to accommodate, in a rigid manner, piezoelectric transducer 22. The latter is formed of an element made, for example of a piezoelectric ceramic material, and may have, in a non-limiting manner, a circular shape, its diameter typically being comprised between ten and fifteen millimetres, and its thickness being of the order of several tens of a millimetre. Piezoelectric transducer 22 is bonded between two top and bottom metal electrodes (not shown), the bottom electrode being rigidly connected to back cover 6 of case 2 by any appropriate means, such as, for example, bonding. According to an alternative embodiment, piezoelectric transducer 22 may be made in the form of a ceramic disc directly bonded onto the metal back cover of case 2 of timepiece 1. According to a further alternative embodiment, transducer 22 is formed by an element made of a piezoelectric ceramic material and bonded onto a metal disc which is itself bonded to the back cover of the case. It goes without saying that piezoelectric transducer 22 could be rigidly fixed to a different place to the back cover of case 2, for example against middle part 4.

Figure 6:
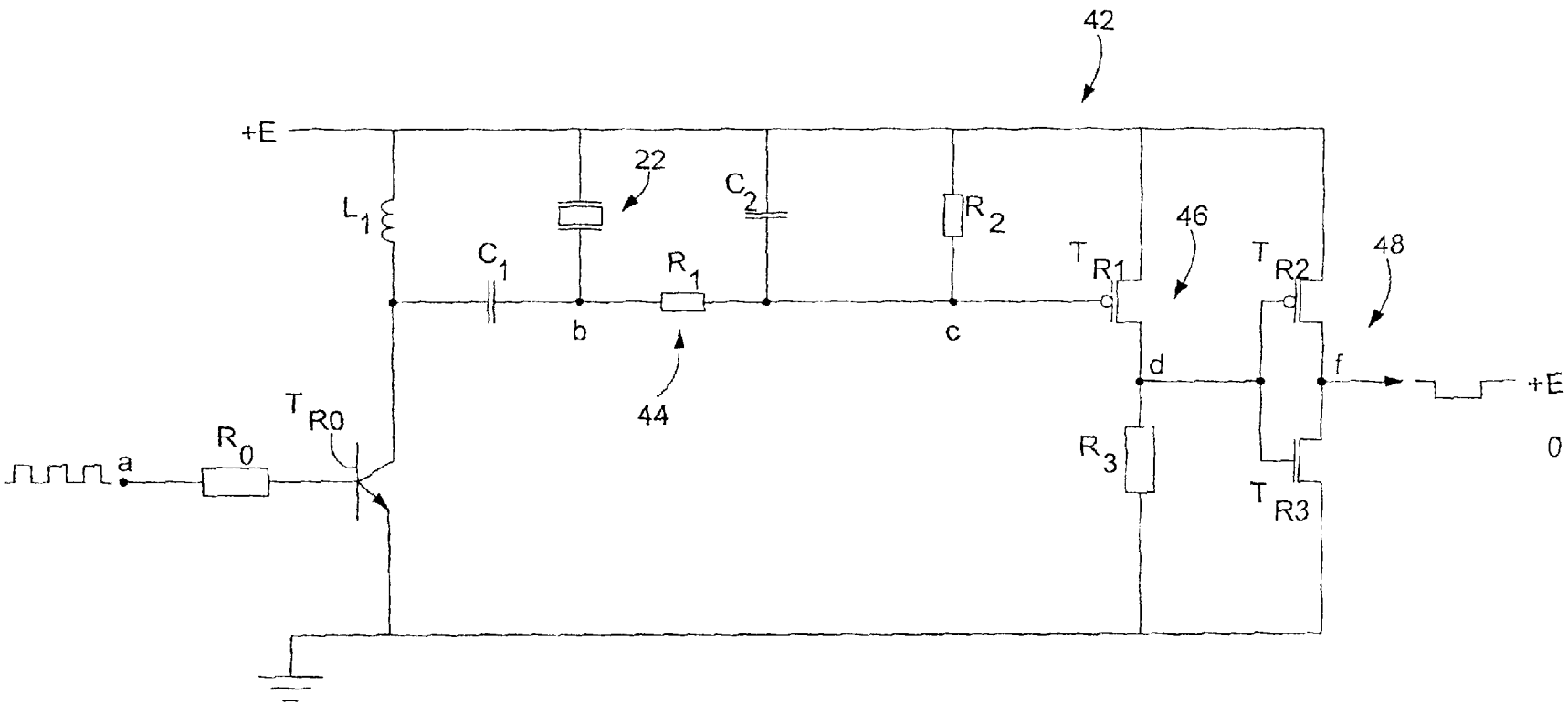
FIG. 6 shows an electric diagram of a circuit allowing a piezoelectric transducer operating as a sound generator to be used to perform the function of a push-button.

The diagram of the electric circuit which allows piezoelectric transducer 22 operating as a sound generator to perform the function of a push-button, will now be examined with reference to FIG. 6. In other words, the user of watch 1, after having selected the desired electronic function by means of the keyboard with capacitive touch-sensitive keys 16, will confirm his selection by exerting pressure on case 2 of timepiece 1. In response to this pressure, piezoelectric transducer 22 is mechanically deformed and generates an electric voltage which will act on the desired horological function via the control circuit described hereinbefore.

As will have been understood, piezoelectric transducer 22 which is fitted to watch 1 according to the invention is used both as a sound generator for the alarm device of watch 1, and as means for activating or deactivating an electronic function such as an horological function by mechanical pressure on case 2 of said watch 1. It goes without saying however that transducer 22 may be used for the sole purpose of confirming the selection of the desired electronic function. The other advantage provided by a piezoelectric sensor used as a strain gauge in the present invention lies in the fact that said piezoelectric sensor is able to emit an acoustic signal at the same time that the user presses on the timepiece case, this acoustic signal indicating to the user that the desired horological function has actually been switched on.

Electric circuit 42 whose diagram is shown in FIG. 6 includes, connected at the output of switching means including a transistor $T_{RO}$ which is alternately conducting and non conducting, a coil $L_1$. Piezoelectric transducer 22 is connected in parallel across coil $L_1$. This electric circuit 42 receives, at an input terminal "a", a square pulse signal. From input terminal "a", this signal is applied to the base of transistor $T_{RO}$ via a resistor $R_O$. When transistor $T_{RO}$ is kept conducting via the pulse of the control signal, an electric current flows through coil $L_1$ from a dc voltage source +E, whereas the connection "b" of piezoelectric transducer 22 is connected by transistor $T_{RO}$ to electric circuit 42's earth.

At the moment when transistor $T_{RO}$ passes to the non conducting state on the trailing leading edge of each pulse, all the energy accumulated in coil $L_1$ is transmitted to the terminals of piezoelectric transducer 22, charging it with a much higher voltage than the supply voltage +E. This pulse of high amplitude supplies piezoelectric transducer 22 with the efficient electric energy it needs to operate as a sound generator. According to a variant, in order to obtain a higher acoustic pressure, a diode (not shown) could be mounted in series with coil $L_1$. For more details concerning this point, reference may be made to Swiss Patent No. CH 641 625 in the name of Seiko.

At this stage of the description, it will be recalled that the circuit elements which have just been described are used solely to drive piezoelectric transducer 22 to make it work as a sound generator in an alarm device fitted to timepiece 1 described hereinbefore. Consequently, these different components are in no way necessary to implement the present invention. They simply allow it to be shown that, owing to the particular features of the invention, a single piezoelectric transducer may advantageously be used both as a sound generator and as means for activating an electronic function such as an horological function of a portable object like a watch. In the following description, we will concentrate on the part of electric circuit 42 which allows a mechanical pressure to be converted into data intelligible to the data control and processing circuit fitted to the timepiece according to the invention and allowing its horological functions to be controlled.

The mechanical pressure exerted by the user on case 2 of timepiece 1 is converted, across the terminals of piezoelectric transducer 22, into an electric signal. Electric circuit 42 includes a capacitor $C_1$, mounted between coil $L_1$ and transducer 22 in order that the impedance seen by the latter is sufficiently high at a low frequency.

Electric circuit 42 is completed by a passive filter 44 mounted in parallel across the terminals of piezoelectric transducer 22. This filter 44 is formed in a conventional manner of a resistor $R_1$ and a capacitor $C_2$. As will easily be understood, filter 40 is used to filter the high frequency signal present across the terminals of transducer 22 when the latter operates as a sound generator at a frequency of the order of 1 kHz, and to prevent this signal propagating towards the amplification and conversion stages which will be described hereinafter. Conversely, at a low frequency, when one acts mechanically on piezoelectric transducer 22, the electric signal can pass. It is thus possible to use piezoelectric transducer 22 simultaneously both as a sound generator and as means for detecting pressure exerted on watch 1. Indeed, during the time when transducer 22 emits an acoustic signal, the high frequency electric signal which results therefrom is filtered by passive filter 44, and thus cannot propagate towards the amplification and conversion stages of electric circuit 42, whereas the low frequency signal resulting from the application of pressure on case 2 of watch 1 is superposed onto the high frequency signal and can pass. An interesting application of this principle lies in the fact that it is for example possible to interrupt the emission of the acoustic signal corresponding to the alarm function of watch 1 simply via mechanical pressure on watch case 2.

Electric circuit 42 includes finally, connected in parallel one after the other at the terminals of passive circuit 44, a polarisation resistor $R_2$, an amplification stage 46 and a conversion stage 48.

Amplification stage 46 includes a transistor $T_{R1}$ whose source is connected to dc voltage source +E and whose drain is connected to a resistor $R_3$. The gate of transistor $T_{R1}$ is connected to one of the ends "c" of resistor $R_2$ whose other end is connected to dc voltage source +E.

For conversion stage 48, one may envisage any of the inverters available in current technology. Solely by way of non-limiting example, conversion stage 48 includes a CMOS inverter which is formed of a PMOS transistor $T_{R2}$ connected to a NMOS transistor $T_{R3}$. The gates of these two transistors $T_{R2}$ and $T_{R3}$ are connected to connection node "d" between the drain of transistor $T_{R1}$ and resistor $R_3$. This connection node "d" constitutes the input of inverter 48. Connection node "f" between the drains of transistors $T_{R2}$ and $T_{R3}$ constitutes the output of the inverter.

Since this is within the grasp of those skilled in the art, it will not be demonstrated here that, when piezoelectric transducer 22 is idle, i.e. when no pressure is exerted on case 2 of timepiece 1, connection node "d" is connected to earth, whereas the voltage at connection node "f" which constitutes the output of conversion stage 48 is equal to +E, so that conversion stage 48 operates like an inverter. Conversely, when mechanical pressure is exerted on piezoelectric transducer 22, the potential at connection node "d" which constitutes the input of conversion stage 48 will increase and tend towards +E whereas, at the same time, the voltage at connection node "f" which constitutes the output of conversion stage 48 will pass to zero. Conversion stage 48 thus operates, in this case too, like an inverter.

The voltage at output node "f" of conversion stage 48 thus passes alternately from value +E when piezoelectric transducer 22 is idle, to a zero voltage value when transducer 22 is activated. This logic signal is applied to the input of the data processing circuit of electronic watch movement 18 which, in response to this signal, will control the horological function of watch 1 selected by the user by means of capacitive touch-sensitive keys 16.

As will be seen hereinafter with reference to FIG. 7, the present invention applies remarkably, for example to the selection and activation of an electronic function such as the timing function in a timepiece.

Figure 7:
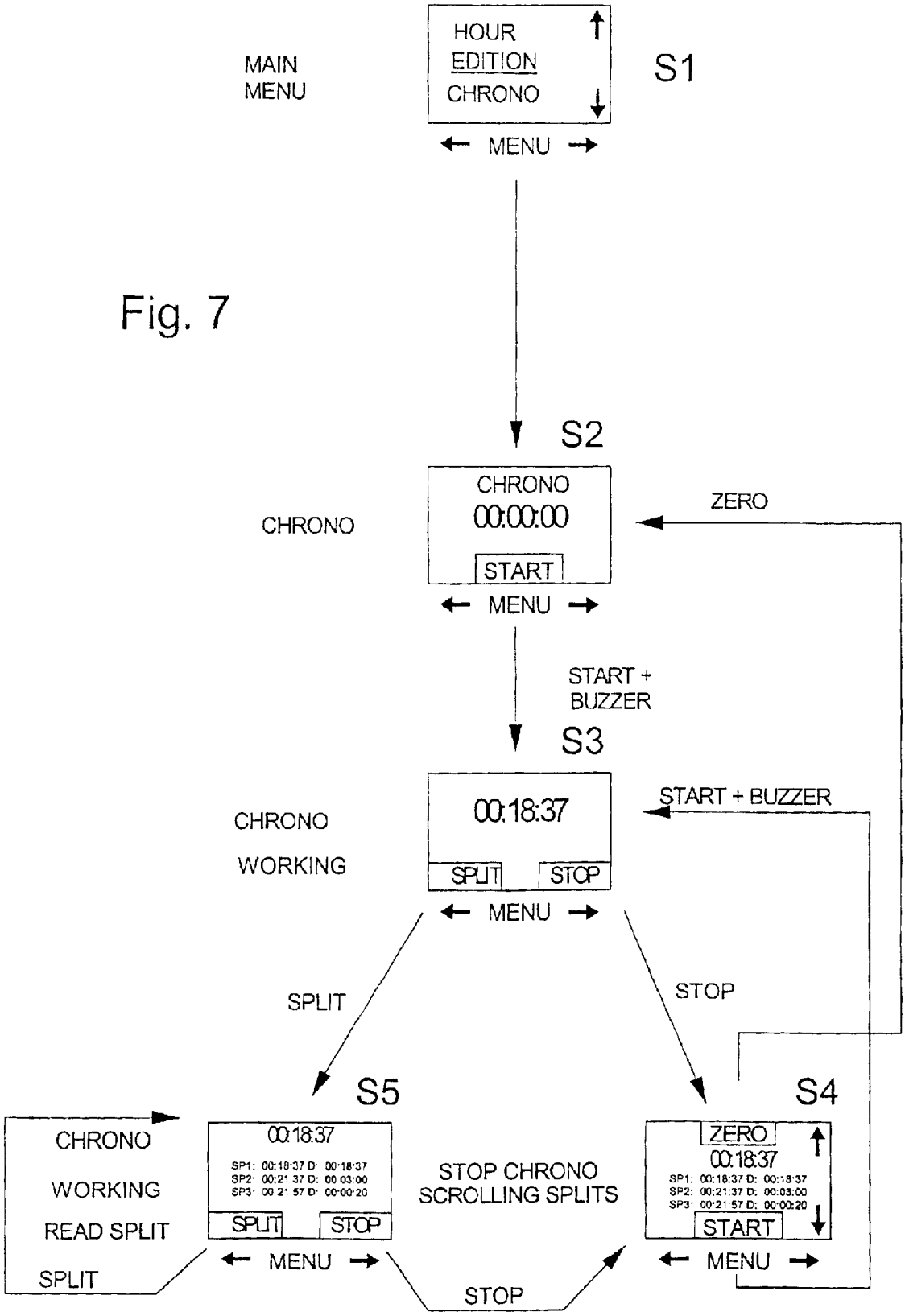
FIG. 7 shows a flow diagram of an implementation example of the method according to the invention.

FIG. 7 illustrates the method for controlling an electronic function such as an horological function according to the present invention. The method begins at step S1 with the selection made by the user of the electronic function which he desires. It is assumed here that the user wishes to activate the timing function of timepiece 1 according to the invention. It can be seen, in step S1, that the user is presented with the main menu offering him several choices. By placing one of his fingers on those tactile keys 16 which are arranged plumb with the arrows pointing upwards and downwards, the user can scroll up or down the menu and enter the timing function which he wants. It will be noted that the marking "menu" and the arrows oriented to the left and the right are characters which may be transcribed onto crystal 8, bezel 14 or the dial of timepiece 1, for example by engraving or by using transfers.

At step S2, the user is in sub-menu which corresponds to the timing function which he has selected. It can be seen at step S2 that the chronometer is at zero and that the user has a "start" key to start timing, for example a sporting event. By applying his finger to the "start" key, the user will be able to select the timing start function. The chronometer will not however be able to start at the instant that the user places his finger on the "start" key. In order to do so, the user will also have to exert pressure on crystal 8 of the timepiece. The user will thus in order select the timing start function by lightly touching the capacitive touch-sensitive key 16 which covers the inscription "start", then observe the sporting event which he wishes to time, and finally, without taking his eyes off the event, he can, by pressure exerted on the same key 16 which covers the inscription "start", start the timing function at the moment that the sports persons rush forward. According to another variant, the chronometer activation function is, as hereinbefore, achieved by lightly touching the appropriate touch-sensitive key 16, then the chronometer is started by pressure on any region of watch 1, for example on crystal 8 of said watch 1 or on a zone of case 2. Advantageously, starting the chronometer by pressure on the timepiece is accompanied by the emission of a short acoustic signal emitted by piezoelectric transducer 22 which will confirm to the user in an audible manner that the chronometer has actually been switched on. Here too, the user will not be obliged to look at his watch 1 in order to ensure that the chronometer has actually been switched on.

Let us assume now that timepiece 1 according to the invention is in the timing mode for quite a long time. It should be noted that the timing mode is an operating mode which consumes a lot of energy since the information displayed by the timepiece has to be continually refreshed. It may then be envisaged that, since the chronometer is still switched on, watch 1 is in a standby state in which it displays, for example, the current time, the user nonetheless having the possibility of stopping the chronometer or measuring an intermediate time at any time by lightly touching the appropriate touch-sensitive key 16 and pressing the same key to validate the selection.

At step S3, the chronometer is switched on and indicates the time which has elapsed since it was started. It can be seen at step S3 that the new sub-menu which is displayed offers the user the choice between stopping timing by means of the key "stop" or measuring an intermediate time by means of the key "split". If he places his finger on the "stop" key and validates his selection by pressing on crystal 8 at the location of the "stop" key, the user reaches step S4 where he has the choice of either resetting the chronometer to zero by means of the "zero" key or restarting the chronometer by means of the "start" key. Restarting the chronometer by means of the "start" key is performed in a similar manner to that described hereinbefore with reference to step S2. The user lightly touches the touch-sensitive key 16 located above the "start" inscription to select the chronometer restart function, then will have to press down on timepiece 1 in order to actually reactivate the timing function. If, conversely, the user places his finger on the "split" key and validates his selection by pressing on crystal 8 of timepiece 1, the user reaches step S5 where the measured intermediate time is displayed. Again, two choices are offered to the user. Either he lightly touches the "split" key and the chronometer records a new intermediate time, or the user places his finger on the "stop" key and he reaches step S4 which was described hereinbefore.

It will thus be noted, upon reading the foregoing, that depending upon the particular case, the user need only place his finger on the appropriate touch-sensitive key 16 of the keyboard in order to select and activate a given electronic function, or the user must not only press on a touch-sensitive key 16 to select the desired function, but must also exert pressure on the timepiece in order to start said function.

It goes without saying that the invention is not limited to the embodiments which have just been described, and that modification and variants may be envisaged without departing from the scope of the present invention. In particular, strain gauge 22 may be a resistive force sensor whose electric resistance varies when mechanical stress is exerted on the structure provided with the resistive force sensor. Strain gauge 22 may also be a measuring device characterised by a variation in the capacitance value of a capacitor as a function of the pressure exerted. Moreover, other data inputing systems by tactile pressure may be used which use inductive, ultrasound or infrared keys.

What is claimed is:

1. A portable object including display means of at least a data item and a case formed of an upper part including a crystal covering said display means and a lower part delimited by a back cover located below said display means, this object further including first and second control means for controlling at least an electronic function such as an horological function, the first control means including at least a touch-sensitive key for selecting the desired electronic function, an electronic data processing circuit identifying the touch-sensitive key activated by touching said key with a finger and deducing therefrom a character or operation thereby selected, wherein the second control means include a strain gauge allowing the selection of the desired electronic function to be confirmed and/or the electronic function to be activated, the confirmation and/or activation of said electronic function being effected by applying pressure to the portable object via the effect of which the strain gauge generates a control signal which will be applied to an electronic data processing circuit, said portable object also providing for inclusion of means for emitting an acoustic signal to indicate to a user that the desired function has actually been switched on.

2. The portable object according to claim 1, wherein the confirmation and/or activation of the desired electronic function is effected by pressing down on the particular touch-sensitive key to apply said pressure thereto, thereby allowing said desired electronic function to be selected.

3. The portable object according to claim 1, wherein the strain gauge is rigidly connected to the case.

4. The portable object according to claim 3, wherein the strain gauge is bonded to the back cover of the case.

5. The portable object according to any of claim 1, wherein the strain gauge is selected from among the group comprising piezoelectric, resistive and capacitive sensors, which are able to generate an electric voltage when a mechanical pressure is exerted on the case, the voltage generated by the force sensor being applied to a first electronic circuit which will generate a logic signal in response to the pressure exerted, this logic signal being applied to the electronic data processing circuit.

6. The portable object according to claim 5, wherein the strain gauge is formed of an element made of a piezoelectric ceramic material bonded between two top and bottom metal electrodes.

7. The portable object according to claim 5, wherein the strain gauge is formed by a ceramic material directly bonded to the back cover of the case when the latter is made of metal.

8. The portable object according to claim 5, wherein the strain gauge is formed by an element made of a piezoelectric ceramic material and bonded onto a metal disc which is itself bonded onto the back cover of the case.

9. The portable object according to claim 5, wherein, when the strain gauge is formed by a piezoelectric transducer, the first electronic circuit includes means for amplifying and converting into a logic signal the voltage generated by the piezoelectric transducer via the effect of the mechanical pressure exerted.

10. The portable object according to claim 9, wherein it further includes a second electronic circuit which causes the piezoelectric transducer to operate as a source of vibrations for an acoustic generator.

11. The portable object according to claim 10, wherein the first electronic circuit also includes means for filtering the electric pulses generated by the piezoelectric transducer when it operates as an acoustic generator, so that said piezoelectric transducer can be simultaneously used as an acoustic generator and as means for detecting pressure exerted on the portable object.

12. The portable object according to claim 1, wherein the first control means uses capacitive, ultrasound or infrared keys.

13. The portable object according to claim 12, wherein at least a part of the touch-sensitive keys is carried by the crystal.

14. The portable object according to claim 12, wherein the touch-sensitive sensors are of the capacitive type, their sensitive pads being formed by transparent electrodes deposited on the lower face of the crystal.

15. The portable object according to claim 14, wherein the sensitive pads of the touch-sensitive sensors are arranged in the form of a matrix defining lines and columns which extend over most of the crystal.

16. The portable object according to claim 14, wherein each electrode is electrically connected to the data processing circuit via a plurality of contact pads located on the periphery of the crystal and two connectors which carry over the electric contacts from the lower face of the crystal onto the upper face of a printed circuit board.

17. The portable object according to claim 16, wherein the connectors are each formed of a succession of vertical conductive and insulating strips, for example made of elastomer.

18. The portable object according to claim 1, wherein it is powered by an accumulator able to be recharged by induction.

19. The portable object according to claim 1, wherein it includes display means for time-related or other data.

20. The portable object according to claim 19, wherein the display means are formed of a matrix type liquid crystal display cell.

21. The portable object according to claim 19, wherein the display means are formed of analogue time display means including an hour hand, a minute hand and a seconds hand which move above a dial which may be formed by a liquid crystal display cell capable of displaying various types of information or data.

22. The portable object according to claim 1, further including said means for emitting an acoustic signal.

23. A method for controlling at least an electronic function of a portable object according to claim 1, including the step of selecting the desired electronic function by applying a finger to the touch-sensitive key associated with said function, wherein it further includes the step of exerting a mechanical stress on the portable object to confirm the selection of said function and/or to activate said function and, if necessary, to generate an acoustic signal to indicate to a user that the desired function has actually been switched on.

24. The method according to claim 23, the stress intended to confirm and/or activate the desired electronic function can be exerted at the same time that the acoustic signal is generated.

25. The method according to claim 23, wherein the selection is confirmed and/or in that the desired electronic function is activated by exerting a mechanical stress right above the particular touch-sensitive key which has allowed said desired electronic function to be selected.

26. The method according to claim 23, wherein, when the portable object is in a timing mode, said portable object is set in a standby mode in which it displays other data, the user nonetheless keeping the possibility of stopping timing or measuring an intermediate time at any moment by lightly touching the appropriate touch-sensitive key and pressing the same key to validate the selection.

* * * * *